US008920127B2

(12) United States Patent
McCaffrey

(10) Patent No.: US 8,920,127 B2
(45) Date of Patent: Dec. 30, 2014

(54) TURBINE ROTOR NON-METALLIC BLADE ATTACHMENT

(75) Inventor: Michael G. McCaffrey, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 699 days.

(21) Appl. No.: 13/184,736

(22) Filed: Jul. 18, 2011

(65) Prior Publication Data

US 2013/0022469 A1 Jan. 24, 2013

(51) Int. Cl.

*F03B 1/04* (2006.01)
*F01D 5/30* (2006.01)
*F01D 5/28* (2006.01)

(52) U.S. Cl.

CPC ..... *F01D 5/3007* (2013.01); *F01D 5/284* (2013.01); *F05D 2230/22* (2013.01); *F05D 2300/6033* (2013.01)
USPC ..... 416/219 R; 415/194

(58) Field of Classification Search

CPC ..... F01D 5/3007
USPC ..... 415/219 R, 192, 194
See application file for complete search history.

(56) References Cited

U.S. PATENT DOCUMENTS 2,920,864 A * 1/1960 Lee ..... 416/196 R
3,887,299 A 6/1975 Profant
4,008,978 A 2/1977 Smale
4,093,399 A * 6/1978 Glenn ..... 416/95
4,363,208 A 12/1982 Hoffman et al.
4,398,866 A 8/1983 Hartel et al.
4,417,854 A * 11/1983 Cain et al. ..... 416/241 B
4,573,320 A 3/1986 Kralick
4,626,461 A 12/1986 Prewo et al.
4,759,687 A 7/1988 Miraucourt et al.
5,092,737 A 3/1992 Lau
5,299,914 A 4/1994 Schilling
5,392,596 A 2/1995 Holsapple et al.
5,466,122 A 11/1995 Charbonnel et al.
6,042,315 A 3/2000 Miller et al.

(Continued)

FOREIGN PATENT DOCUMENTS

GB 2250782 A 6/1992
WO 2010146288 A1 12/2010

OTHER PUBLICATIONS

Characterization of First-Stage Silicon Nitride Components After Exposure to an Industrial Gas Turbine H.-T. Lin,*,M. K. Ferber,* and P. F. Becher, J. R. Price, M. van Roode, J. B. Kimmel, and O. D. Jimenez J. Am. Ceram. Soc., 89 [1] 258-265 (2006).

(Continued)

*Primary Examiner* — Dwayne J White
(74) *Attorney, Agent, or Firm* — Bachman & LaPointe, P.C.

(57) ABSTRACT

In an engine disk and blade combination, the metallic disk has a plurality of first blade attachment slots and a plurality of second blade attachment slots circumferentially interspersed with each other. There is a circumferential array of a plurality of first blades. Each first blade has an airfoil and an attachment root. The attachment roots are respectively received in associated said first attachment slots. There is a circumferential array of second blades. Each second blade has an airfoil and an attachment root. The attachment roots are respectively received in associated said second slots. The first blades and second blades are non-metallic. The first blades are radially longer than the second blades. The first slots are radially deeper than the second slots.

12 Claims, 2 Drawing Sheets

(56) References Cited

U.S. PATENT DOCUMENTS

| | | | |
|---|---|---|---|
| 6,045,310 | A | 4/2000 | Miller et al. |
| 6,197,424 | B1 | 3/2001 | Morrison et al. |
| 6,200,092 | B1 | 3/2001 | Koschier |
| 6,241,471 | B1 | 6/2001 | Herron |
| 6,250,883 | B1 | 6/2001 | Robinson et al. |
| 6,325,593 | B1 | 12/2001 | Darkins, Jr. et al. |
| 6,451,416 | B1 | 9/2002 | Holowczak et al. |
| 6,514,046 | B1 | 2/2003 | Morrison et al. |
| 6,648,597 | B1 | 11/2003 | Widrig et al. |
| 6,676,373 | B2 | 1/2004 | Marlin et al. |
| 6,696,144 | B2 | 2/2004 | Holowczak et al. |
| 6,709,230 | B2 | 3/2004 | Morrison et al. |
| 6,733,233 | B2 | 5/2004 | Jasklowski et al. |
| 6,746,755 | B2 | 6/2004 | Morrison et al. |
| 6,758,386 | B2 | 7/2004 | Marshall et al. |
| 6,758,653 | B2 | 7/2004 | Morrison |
| 6,808,363 | B2 | 10/2004 | Darkins, Jr. et al. |
| 6,854,738 | B2 | 2/2005 | Matsuda et al. |
| 6,893,214 | B2 | 5/2005 | Alford et al. |
| 6,910,853 | B2 | 6/2005 | Corman et al. |
| 6,935,836 | B2 | 8/2005 | Ress, Jr. et al. |
| 7,090,459 | B2 | 8/2006 | Bhate et al. |
| 7,093,359 | B2 | 8/2006 | Morrison et al. |
| 7,094,027 | B2 | 8/2006 | Turner et al. |
| 7,114,917 | B2 | 10/2006 | Legg |
| 7,117,983 | B2 | 10/2006 | Good et al. |
| 7,153,096 | B2 | 12/2006 | Thompson et al. |
| 7,198,454 | B2 | 4/2007 | Evans |
| 7,198,458 | B2 | 4/2007 | Thompson |
| 7,247,003 | B2 | 7/2007 | Burke et al. |
| 7,278,830 | B2 | 10/2007 | Vetters |
| 7,384,240 | B2 | 6/2008 | McMillan et al. |
| 7,434,670 | B2 | 10/2008 | Good et al. |
| 7,435,058 | B2 | 10/2008 | Campbell et al. |
| 7,452,182 | B2 | 11/2008 | Vance et al. |
| 7,452,189 | B2 | 11/2008 | Shi et al. |
| 7,488,157 | B2 | 2/2009 | Marini et al. |
| 7,491,032 | B1 | 2/2009 | Powell et al. |
| 7,497,662 | B2 | 3/2009 | Mollmann et al. |
| 7,510,379 | B2 | 3/2009 | Marusko et al. |
| 7,534,086 | B2 | 5/2009 | Mazzola et al. |
| 7,546,743 | B2 | 6/2009 | Bulman et al. |
| 7,600,970 | B2 | 10/2009 | Bhate et al. |
| 7,647,779 | B2 | 1/2010 | Shi et al. |
| 7,648,336 | B2 | 1/2010 | Cairo |
| 7,665,960 | B2 | 2/2010 | Shi et al. |
| 7,726,936 | B2 | 6/2010 | Keller et al. |
| 7,753,643 | B2 | 7/2010 | Gonzalez et al. |
| 7,762,768 | B2 | 7/2010 | Shi et al. |
| 7,771,160 | B2 | 8/2010 | Shi et al. |
| 7,785,076 | B2 | 8/2010 | Morrison et al. |
| 7,824,152 | B2 | 11/2010 | Morrison |
| 2005/0158171 | A1 | 7/2005 | Carper et al. |
| 2005/0254942 | A1 | 11/2005 | Morrison et al. |
| 2007/0072007 | A1 | 3/2007 | Carper et al. |
| 2008/0034759 | A1 | 2/2008 | Bulman et al. |
| 2010/0021290 | A1 | 1/2010 | Schaff et al. |
| 2010/0032875 | A1 | 2/2010 | Merrill et al. |
| 2010/0111678 | A1 | 5/2010 | Habarou et al. |
| 2010/0226760 | A1 | 9/2010 | McCaffrey |
| 2010/0257864 | A1 | 10/2010 | Prociw et al. |
| 2011/0027098 | A1 | 2/2011 | Noe et al. |
| 2011/0052384 | A1 | 3/2011 | Shi et al. |

OTHER PUBLICATIONS

Evaluation of Mechanical Stability of a Commercial Sn88 Silicon Nitride at Intermediate Temperatures Hua-Tay Lin,* Mattison K. Ferber,* and Timothy P. Kirkland*, J. Am. Ceram. Soc., 86 [7] 1176-81 (2003).

Research and Development of Ceramic Turbine Wheels, K. Watanab, M. Masuda T. Ozawa, M. Matsui, K. Matsuhiro, 36 I vol. 115, Jan. 1993, Transactions of the ASME.

A.L. Neuburger and G. Carrier, Design and Test of Non-rotating Ceramic Gas Turbine Components, ASME Turbo Expo 1988, ASME paper 88-GT-146.

Vedula, V., Shi, J., Liu, S., and Jarmon, D. "Sector Rig Test of a Ceramic Matrix Composite (CMC) Combustor Liner", GT2006-90341, Proceedings of GT2006, ASME turbo Expo 2006: Power for Land, Sea and Air, Barcelona, Spain, May 8-11, 2006.

Bhatia, T., "Enabling Technologies for Hot Section Components", Contract N00014-06-C-0585, Final Report, Jan. 30, 2009.

Vedula, V., et al., "Ceramic Matrix Composite Turbine Vanes for Gas Turbine Engines", ASME Paper GT2005-68229, Proceedings of ASME Turbo Expo 2005, Reno, Nevada, Jun. 6-9, 2005.

Verrilli, M., Calamino, A., Robinson, R.C., and Thomas, D.J., "Ceramic Matrix Composite Vane Subelement Testing in a Gas Turbine Environment", Proceedings of ASMW Turbo Expo 2004, Power for Land, Sea, and Air, Jun. 14-17, 2004, Vienna, ASME Paper GT2004-53970.

Watanbe, K., Suzumura, N., Nakamura, T., Murata, H., Araki, T., and Natsumura, T., "Development of CMC Vane for Gas Turbine Engine", Ceramic Engineering and Science Proceedings, vol. 24, Issue 4, 2003, pp. 599-604.

Calamino, A. and Verrilli, M., "Ceramic Matrix Composite Vane Subelement Fabrication", Proceedings of ASME Turbo Expo 2004, Power for Land, Sea, and Air, Jun. 14-17, 2004, Vienna, ASME Paper GT2004-53974.

Bhatia, T., et al., "CMC Combustor Line Demonstration in a Small Helicopter Engine", ASME Turbo Expo 2010, Glasgow, UK, Jun. 14-18, 2010.

* cited by examiner

TURBINE ROTOR NON-METALLIC BLADE ATTACHMENT

BACKGROUND

The disclosure relates to turbine blades. More particularly, the disclosure relates to attachment of non-metallic blades to turbine disks in gas turbine engines.

Gas turbine engines contain rotating blade stages in fan, compressor, and/or turbine sections of the engine.

In the turbine sections, high temperatures have imposed substantial constraints on materials. An exemplary turbine section blade is formed of a cast nickel-based superalloy having an internal air cooling passageway system and a thermal barrier coating (TBC). The exemplary blade has an airfoil extending radially outward from a platform. A so-called fir tree/dovetail attachment root depends from the platform and is accommodated in a complementary slot in a disk. The exemplary disk materials are powder metallurgical (PM) nickel-based superalloys.

The weight of nickel-based superalloys and the dilution associated with cooling air are both regarded as detrimental in turbine engine design.

SUMMARY

One aspect of the disclosure involves an engine disk and blade combination. A metallic disk has a plurality of first blade attachment slots and a plurality of second blade attachment slots circumferentially interspersed with each other. There is a circumferential array of a plurality of first blades. Each first blade has an airfoil and an attachment root. The attachment roots are respectively received in associated said first attachment slots. There is a circumferential array of second blades. Each second blade has an airfoil and an attachment root. The attachment roots are respectively received in associated said second slots. The first blades and second blades are non-metallic. The first blades are radially longer than the second blades. The first slots are radially deeper than the second slots.

In various implementations, the combination may be a turbine stage. The disk may comprise a nickel-based superalloy. The first blades and second blades may comprise a structural ceramic or ceramic matrix composite (CMC). The second blades may have a characteristic chord, less than a characteristic chord of the first blades. The second blades may have a characteristic leading edge axial position axially recessed relative to a characteristic leading edge axial position of the first blades.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
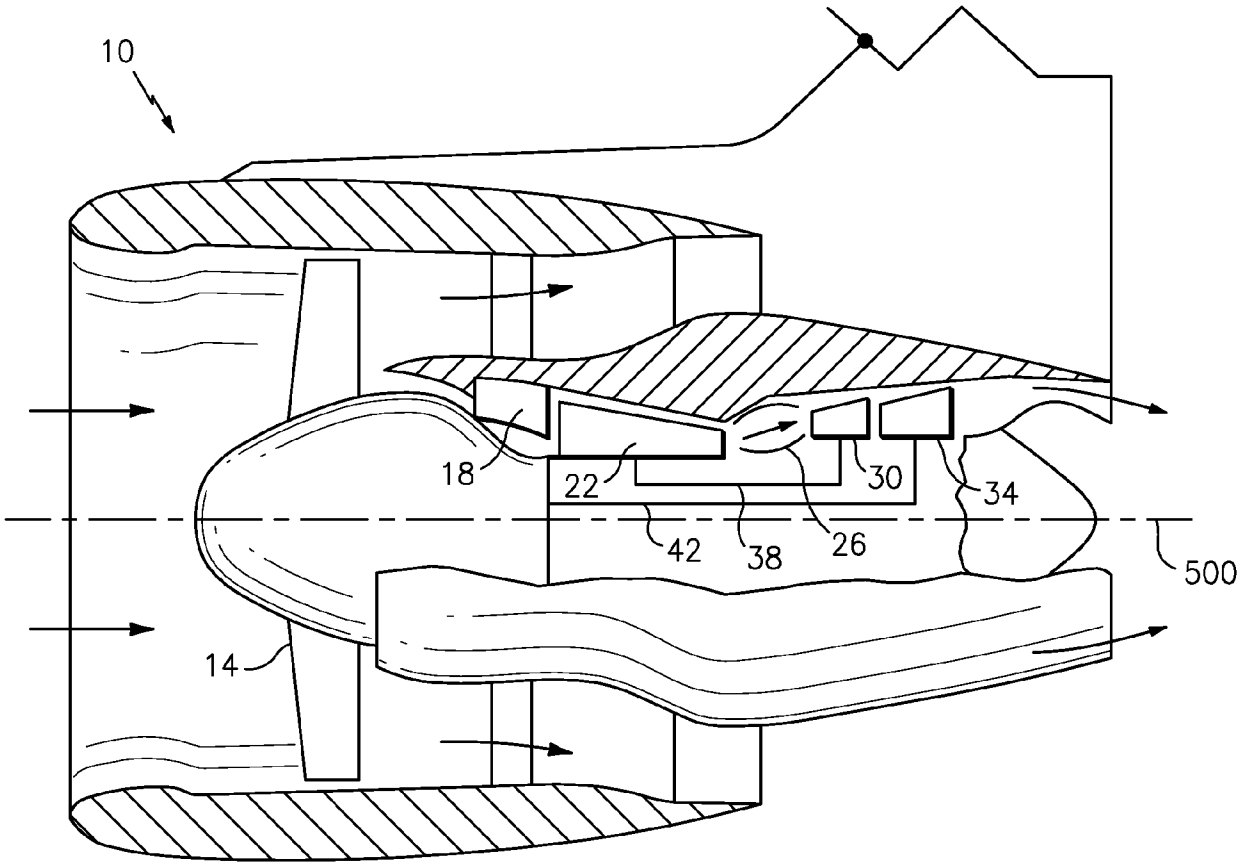
FIG. 1 is a partially schematic axial/radial sectional view of a gas turbine engine.

FIG. 1 schematically illustrates an exemplary gas turbine engine 10 including (in serial flow communication from upstream to downstream and fore to aft) a fan section 14, a low-pressure compressor (LPC) section 18, a high-pressure compressor (HPC) section 22, a combustor 26, a high-pressure turbine (HPT) section 30, and a low-pressure turbine (LPT) section 34. The gas turbine engine 10 is circumferentially disposed about an engine central longitudinal axis or centerline 500. During operation, air is: drawn into the gas turbine engine 10 by the fan section 14; pressurized by the compressors 18 and 22; and mixed with fuel and burned in the combustor 26. The turbines 30 and 34 then extract energy from the hot combustion gases flowing from the combustor 26.

In a two-spool (two-rotor) design, the blades of the HPC and HPT and their associated disks, shaft, and the like form at least part of the high speed spool/rotor and those of the LPC and LPT form at least part of the low speed spool/rotor. The fan blades may be formed on the low speed spool/rotor or may be connected thereto via a transmission. The high-pressure turbine 30 utilizes the extracted energy from the hot combustion gases to power the high-pressure compressor 22 through a high speed shaft 38. The low-pressure turbine 34 utilizes the extracted energy from the hot combustion gases to power the low-pressure compressor 18 and the fan section 14 through a low speed shaft 42. The teachings of this disclosure are not limited to the two-spool architecture. Each of the LPC, HPC, HPT, and HPC comprises interspersed stages of blades and vanes. The blades rotate about the centerline with the associated shaft while the vanes remain stationary about the centerline.

Figure 2:
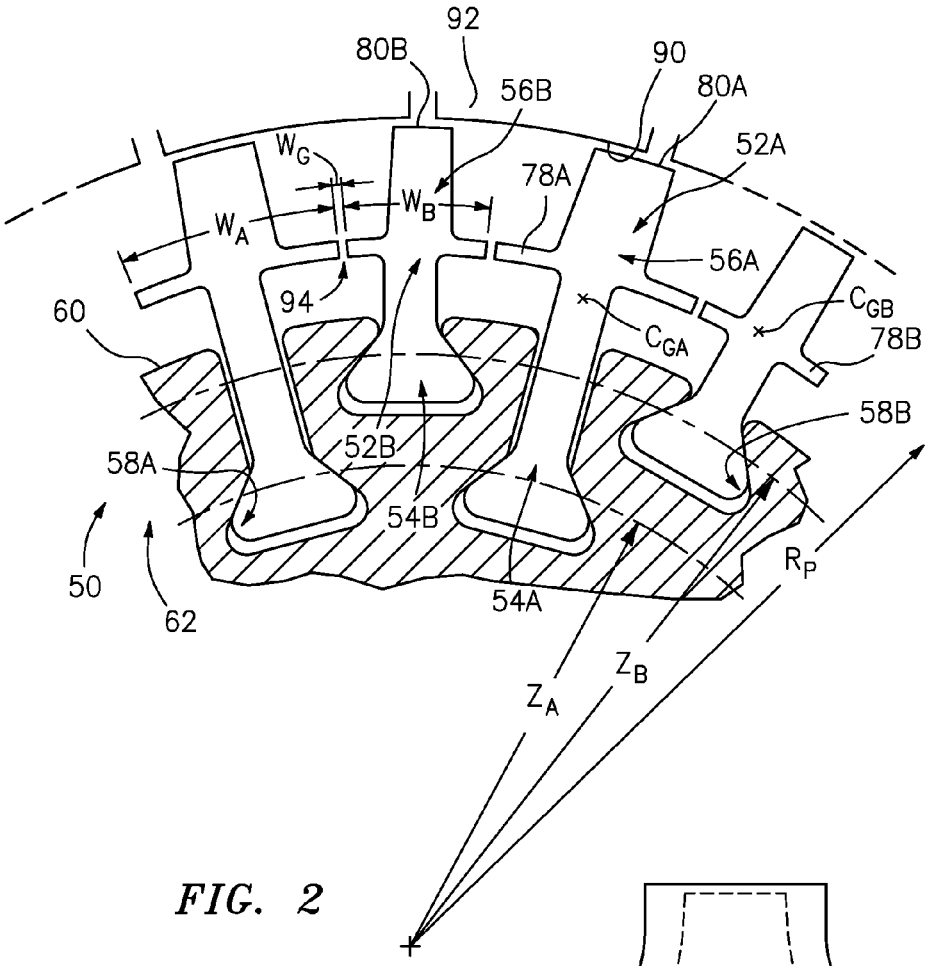
FIG. 2 is a partial axial schematic view of turbine disk and associated blade stage.

FIG. 2 shows one of the stages 50 of blades. As is discussed further below, the stage comprises alternatingly interspersed pluralities of first blades 52A and second blades 52B. Each blade comprises an attachment root 54A, 54B and an airfoil 56A, 56B. The roots are received in respective slots 58A, 58B extending radially inward from the periphery 60 of a disk 62. The exemplary disk is metallic (e.g., a nickel-based superalloy which may be of conventional disk alloy type). The exemplary blades, however, are non-metallic. The exemplary non-metallic blades are ceramic based (e.g., wherein at least 50% of a strength of the blade is a ceramic material). Exemplary non-metallic materials are monolithic ceramics, ceramic matrix composites (CMCs) and combinations thereof.

Attachment of such non-metallic blades poses problems. Relative to metallic blades, the non-metallic blades may have low modulus and low volumetric strength. Additionally, various ceramic-based materials may have particular strength deficiencies. For example, CMC materials have relatively high tensile strength yet relatively low interlaminar tensile strength. An exemplary ceramic matrix composite comprises a stack of plies extending generally radially through the root and the blade. Attachment stresses may cause interlaminar stresses to the plies within the root. Retaining the blades may require a relatively large attachment root compared with a metal blade of similar size. The increased root size may be needed to provide sufficient strength at the root and/or provide its efficiently distributed engagement of contact forces between the slot and the root. Providing such an attachment root might otherwise necessitate either too tight a root-to-root spacing (thereby weakening the disk) or too long (axially) of a root (thereby increasing stage-to-stage axial spacing and correspondingly reducing efficiency).

FIG. 2 further shows each airfoil as extending from an inbourd end at a platform 78A, 78B to a tip 80A, 80B. Each airfoil has (FIG. 3) a leading edge 82A, 82B; a trailing edge 84A, 84B, a pressure side 86A, 86B, and a suction side 88A, 88B. The exemplary tips 80A and 80B are in close facing proximity to inboard faces 90 of an array of blade outer air seal (BOAS) segments 92. The blade platforms have respective arc widths or circumferential extents $W_A$ and $W_B$. Exemplary $W_A$ is larger than $W_B$. Exemplary $W_B$ is 33-100% of $W_A$, more narrowly, 50-90% or 75-85%. An inter-platform gap 94 has a circumferential extent $W_G$ which is relatively small. Alternatively defined, $W_A$, $W_B$, $W_G$ may be measured as linear lengths measured circumferentially in a platform radius $R_P$ (e.g., measured at the outboard boundary of the platform). The exemplary first platforms occupy approximately 50-75% of the total circumference, more narrowly, 60-70%. The exemplary second platforms may represent 25-50%, more narrowly, 30-40%. An exemplary width of the gap is 0.000-0.005 inch (0.0-0.13 mm) accounting for a very small percentage of total circumference.

To provide sufficient attachment strength, the exemplary slots 58A and 58B and their associated blade roots are radially staggered. The first slots 58A have a characteristic radius $Z_A$. The exemplary second slots have a characteristic radius $Z_B$. Radius Z is defined as the radial distance from the disk center of rotation to a line connecting the mid-points of the blade to disk contact surface from the pressure side to the suction side of the attachment. This radial dimension is typically measured on a plane, normal to the axis of rotation, described by line going from the center of disk rotation through the centerline of the defined attachment configuration, and roughly half the axial distance, of the blade attachment, from the front of the blade attachment.

Robust blade-to-disk attachment may be provided in one or more of several ways. First, the radial stagger alone may provide more of an interfitting of the two groups of roots. Additionally, one of the groups (e.g., the outboard shifted second group) may have smaller airfoils (weighing less and, thereby, necessitating a correspondingly smaller attachment root and slot).

Figure 3:
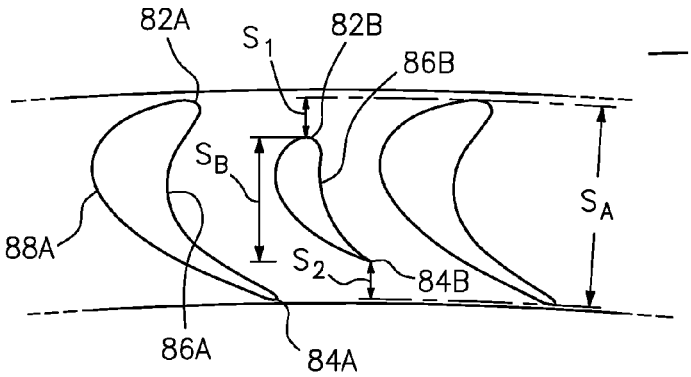
FIG. 3 is a partial radially inward view of blades of the stage of FIG. 2.
Figure 4:
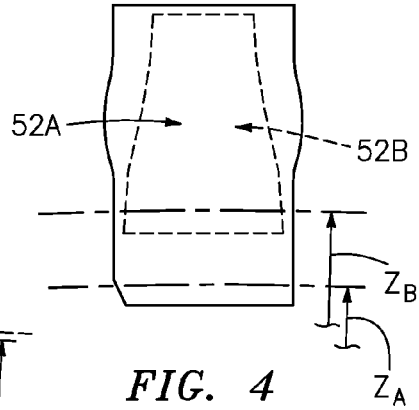
FIG. 4 is a circumferential projection of first and second blades of the stage of FIG. 2.

In a first example, FIGS. 3 and 4 show the exemplary second blade airfoils 56B as having a similar radial span to the first blade airfoils 56A (i.e., so that the respective tips 80B and 80A are at the same radial position relative to the engine centerline 500). An exemplary reduced size of the second airfoils results from reduced chord length. FIG. 3 shows the airfoils 56B of the second blades as having a relatively greater spanwise taper than the airfoils 56A of the first blades (so that the tip chord of the airfoils of the second blades is smaller than the tip chord of the airfoils of the first blades whereas, near the root, the chords are closer to equal). FIG. 3 shows the forward extremes of the tips of the second airfoils recessed axially aftward by a separation $S_1$ relative to those of the first airfoils. FIG. 3 further shows a forward recessing of the trailing extremes by a distance $S_2$. In the exemplary embodiment, at a given axial position, the tips of the first and second blades are at like radial positions (e.g., so that they may have similar interactions with outer air seals or other adjacent structures).

Exemplary $Z_B$ is 105-125% of $Z_A$, more narrowly, 110-115%. An exemplary mass of the second blades is 50-100% of a mass of the first blades, more narrowly, 60-95% or 75-85%. An exemplary longitudinal span $S_B$ of the second blade airfoils is 50-100% of a longitudinal span $S_A$ of the first blade airfoils at the tips, more narrowly, 70-95% or 85-95%. FIG. 2 further shows exemplary blade centers of gravity $C_{GA}$ and $C_{GB}$. Broadly, exemplary $C_{GB}$ and $C_{GA}$ are radially within a few percent of each other (90-110% of each other). Although either can be radially outboard, exemplary $C_{GB}$ is slightly radially outboard of $C_{GA}$ (e.g., at a radius of 100-110% of $C_{GA}$, more narrowly, 101-105%). Exemplary $C_{GA}$ and $C_{GB}$ may be at the same axial position (e.g., along the transverse centerplane of the disk for balance). Alternative implementations may axially stagger $C_{GA}$ and $C_{GB}$ while maintaining balance.

One or more embodiments have been described. Nevertheless, it will be understood that various modifications may be made. For example, when implemented in the remanufacture of the baseline engine or the reengineering of a baseline engine configuration, details of the baseline configuration may influence details of any particular implementation. Although an ABAB . . . pattern is shown, alternative patterns may have unequal numbers of the respective blades (e.g., an AABAAB . . . pattern or an ABBABB . . . pattern). Accordingly, other embodiments are within the scope of the following claims.

What is claimed is:

1. An engine disk and blade combination comprising:

a metallic disk having: a plurality of first blade attachment slots; and a plurality of second blade attachment slots, circumferentially interspersed with the first attachment slots;

a circumferential array of first blades, each first blade comprising: an airfoil; and an attachment root, the attachment root received in an associated respective said first attachment slot; and a circumferential array of second blades, each second blade comprising: an airfoil; and an attachment root, the attachment root received in an associated respective said second attachment slot, wherein:

the first blades and second blades are non-metallic;

the first blades are radially longer than the second blades;

the first slots are radially deeper than the second slots;

tips of the first blades are at like radial positions to tips of the second blades at a given axial position;

the first blades have a characteristic chord;

the second blades have a characteristic chord, less than the characteristic chord of the first blades;

the first slots have a first circumferential span; and the second slots have a second circumferential span, less than the first circumferential span.

2. The combination of claim 1 wherein:

the first blade attachment slots and second blade attachment slots are alternatingly interspersed in the absence of additional interspersed slots.

3. The combination of claim 1 wherein:

there are equal numbers of the first blade attachment slots and second blade attachment slots interspersed one after the other.

4. The combination of claim 1 wherein:

the combination is a turbine stage.

5. The engine of claim 1 wherein:

the disk comprises a nickel-based superalloy; and the first blades and second blades comprise a structural ceramic or ceramic matrix composite.

6. The combination of claim 1 wherein:

the first blades have a characteristic tip longitudinal span; and the second blades have a characteristic tip longitudinal span, less than the characteristic tip longitudinal span of the first blades.

7. The combination of claim 1 wherein:

the first blades have a characteristic leading edge axial position; and the second blades have a characteristic leading edge axial position, aft of the characteristic leading edge axial position of the first blades.

8. The combination of claim 1 wherein:

the first slots have a first mass and a first center of gravity position; and the second slots have a second mass, less than the first mass and a second center of gravity position radially outboard of the first center of gravity position.

9. The combination of claim 1 wherein:

the second blades have centers of gravity radially outboard of centers of gravity of the first blades.

10. The combination of claim 1 wherein:

the first blades have platforms of equal circumferential span to platforms of the second blades.

11. The combination of claim 1 wherein:

the first blades have platforms of circumferentially greater span than platforms of the second blades.

12. An engine disk and blade combination comprising:

a metallic disk having: a plurality of first blade attachment slots; and a plurality of second blade attachment slots, circumferentially interspersed with the first attachment slots;

a circumferential array of first blades, each first blade comprising: an airfoil; and an attachment root, the attachment root received in an associated respective said first attachment slot; and a circumferential array of second blades, each second blade comprising: an airfoil; and an attachment root, the attachment root received in an associated respective said second attachment slot, wherein:

the first blades and second blades are non-metallic;

the first blades are radially longer than the second blades;

the first slots are radially deeper than the second slots;

tips of the first blades are at like radial positions to tips of the second blades at a given axial position;

the first blades have a characteristic chord;

the second blades have a characteristic chord, less than the characteristic chord of the first blades; and the first blades have platforms of circumferentially greater span than platforms of the second blades.

* * * * *